US008915220B2

(12) United States Patent
Gecim

(10) Patent No.: US 8,915,220 B2
(45) Date of Patent: Dec. 23, 2014

(54) VARIABLE VALVE ACTUATION MECHANISM FOR OVERHEAD-CAM ENGINES WITH AN OSCILLATING/SLIDING FOLLOWER

(75) Inventor: Burak A. Gecim, Carmel, IN (US)

(73) Assignee: GM Global Technology Operations LLC, Detroit, MI (US)

( * ) Notice: Subject to any disclaimer, the term of this patent is extended or adjusted under 35 U.S.C. 154(b) by 180 days.

(21) Appl. No.: 13/038,445

(22) Filed: Mar. 2, 2011

(65) Prior Publication Data

US 2012/0222636 A1 Sep. 6, 2012

(51) Int. Cl.

| | |
|---|---|
| ***F01L 1/34*** | (2006.01) |
| ***F01L 1/30*** | (2006.01) |
| ***F01L 1/18*** | (2006.01) |
| ***F01L 3/10*** | (2006.01) |
| ***F01L 13/00*** | (2006.01) |
| *F01L 1/46* | (2006.01) |

(52) U.S. Cl.

CPC ..... *F01L 1/185* (2013.01); *F01L 2001/467* (2013.01); *F01L 13/0021* (2013.01); *F01L 2001/186* (2013.01); *F01L 2105/00* (2013.01)

USPC ..... 123/90.16; 123/90.17; 123/90.25; 123/90.44; 123/90.65

(58) Field of Classification Search

CPC .... F01L 1/185; F01L 13/0021; F01L 13/0063

USPC ..... 123/90.16, 90.17, 2, 26

See application file for complete search history.

(56) References Cited

U.S. PATENT DOCUMENTS

| | | | | |
|---|---|---|---|---|
| 5,584,267 | A * | 12/1996 | Muir | 123/90.39 |
| 5,697,333 | A * | 12/1997 | Church et al. | 123/90.16 |
| 6,446,589 | B1 * | 9/2002 | Nguyen | 123/90.16 |
| 6,668,779 | B2 * | 12/2003 | Hendriksma et al. | 123/90.44 |
| 6,782,853 | B2 * | 8/2004 | Kanamaru et al. | 123/90.15 |
| 7,185,927 | B2 * | 3/2007 | Talukdar et al. | 292/172 |
| 7,305,951 | B2 * | 12/2007 | Fernandez et al. | 123/90.39 |
| 7,610,882 | B2 * | 11/2009 | Tsutsumi et al. | 123/90.16 |
| 7,677,213 | B2 * | 3/2010 | Deierlein | 123/90.16 |
| 2002/0023603 | A1 * | 2/2002 | Nohara et al. | 123/90.15 |
| 2007/0101957 | A1 * | 5/2007 | Shui | 123/90.16 |
| 2008/0017152 | A1 * | 1/2008 | Fernandez et al. | 123/90.39 |

* cited by examiner

*Primary Examiner* — Thomas Denion
*Assistant Examiner* — Deming Wan

(57) ABSTRACT

A finger follower apparatus to effect opening of an engine valve includes a first member with first and second opposite ends. The first member is pivotally fixed at the first end and operatively engaged with the engine valve at the second end. A second member is slidably engaged with the first member and carries a roller for engagement with a cam.

6 Claims, 5 Drawing Sheets

VARIABLE VALVE ACTUATION MECHANISM FOR OVERHEAD-CAM ENGINES WITH AN OSCILLATING/SLIDING FOLLOWER

TECHNICAL FIELD

This disclosure is related to valve control of internal combustion engines.

BACKGROUND

The statements in this section merely provide background information related to the present disclosure and may not constitute prior art.

Known internal combustion engines include valve trains that have a roller finger follower that transfers rotary motion of a camshaft and, more specifically, a lobe thereof to actuate an engine valve. Known roller finger followers include a body with a first end engaging a lash adjuster and an opposing end that engages a valve stem. For an overhead cam engine, a roller is positioned between the two ends of the roller finger follower for engaging the lobe of the camshaft. The lobe thereby provides pivotal motion about the valve lash adjuster and creates linear motion of the valve and causing the valve to open and close. The timing of the valve opening and closing is important to maximize fuel efficiency, assure complete combustion, minimize emissions, and maximize engine output. Adjustable valve timing can provide preferred valve dynamics for a various range of engine speeds and thereby creating the benefits described above.

Adjustable valve timing can be achieved by a multiple lobe camshaft acting upon a roller finger follower. A first lobe is for low-valve lift engine operation and a second lobe is for high-valve lift engine operation. The cam lobes may have switchable operation or independent finger followers. There may also be a two step finger follower. The two step finger follower is switchable between a low-lift valve actuation position and a high-lift valve actuation position. The low-lift valve actuation position generally includes a lost motion device for reducing the motion received from the cam lobe through the finger follower to the valve. These devices have torsion springs which can create excessive variation in the installed load and create coil binding thereby causing variation in valve lift. These devices do not allow for a third discrete step allowing for a transition between a low valve lift, a high valve lift, and a no valve lift position or for an infinitely variable lift position.

SUMMARY

A finger follower apparatus to effect opening of an engine valve includes a first member with first and second opposite ends. The first member is pivotally fixed at the first end and operatively engaged with the engine valve at the second end. A second member is slidably engaged with the first member and carries a roller for engagement with a cam.

BRIEF DESCRIPTION OF THE DRAWINGS

One or more embodiments will now be described, by way of example, with reference to the accompanying drawings, in which.

DETAILED DESCRIPTION

Figure 1:
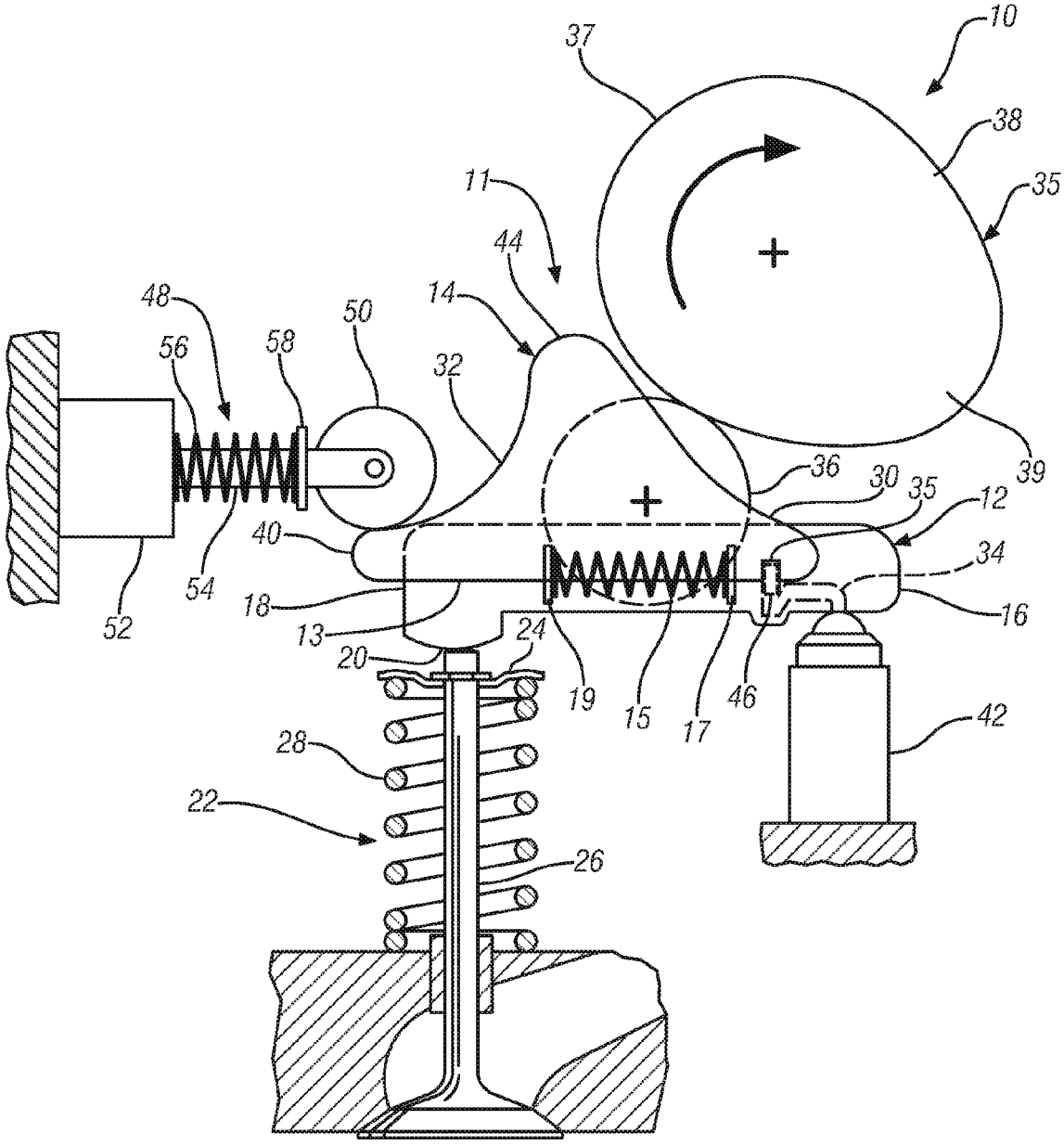
FIG. 1 schematically illustrates a portion of an internal combustion engine including a valve train, and a control guide, in accordance with the present disclosure.

Referring now to the drawings, wherein the showings are for the purpose of illustrating certain exemplary embodiments only and not for the purpose of limiting the same, FIG. 1 schematically illustrates a portion of an internal combustion engine including a valve train 10 and a control guide 14. The valve train 10 includes an engine valve 22 actuated by a rotating camshaft 35 using a finger follower 11. As shown, the engine valve 22 is in a non actuated position. The finger follower 11 includes a first member (base 12), a second member (control guide 14), and a valve lift actuator 48.

The base 12 is an elongated element that extends from a first end 16 to a second end 18. The first end 16 is pivotally interconnected to a valve lash adjuster 42 which resides in the engine to support the finger follower 11. The second end 18 includes a contact surface 20 for engaging a valve stem 26 of the engine valve 22.

The control guide 14 has a substantially triangular shape including a base portion 13, a control surface portion 32, and a roller portion 30. The base portion 13 of the control guide 14 rests on and mechanically interacts with the base 12 of the finger follower apparatus 11, including transferring opening force from the camshaft 35 to the engine valve 22. The control surface portion 32 is configured to interact with a guide roller 50 of the valve lift actuator 48 under specific conditions. The control surface portion 32 preferably includes an arcuate surface extending between a base end 40 and a top end 44 to engage the guide roller 50 of the valve lift actuator 48. The roller portion 30 extends between the top end 44 and the first end 16 of the base 12, and includes an attached cam follower (e.g. roller 36) that is configured to engage a cam lobe 38 of the camshaft 35. The roller 36 is rotatably attached to the control guide 14 using, e.g., one of roller bearings, ball bearings, and a bearing shaft.

The valve lift actuator 48 includes a linear actuator 52 having an extendable biasing arm 54 that connects at a distal end to the guide roller 50. In one embodiment, the biasing arm 54 includes a biasing member 56, e.g., a coil spring, between the linear actuator 52 and a retention plate 58. The guide roller 50 is rotationally connected to the biasing arm 54 using, e.g., one of roller bearings, ball bearings, and roller pins. The linear actuator 52 is configured to extend the biasing arm 54 and guide roller 50 over a range between a fully extended position and a fully retracted position. The linear actuator 52 may be, e.g., a hydraulic, electrical, or magnetic actuator. The linear actuator 52 of the valve lift actuator 48 is rigidly mounted to the engine, preferably to an engine head. The valve lift actuator 48 is controlled according to the type of mechanism utilized, e.g., a hydraulic actuator is hydraulically actuated by a supply of fluid, e.g., engine oil, or an electrical actuator is actuated by way of a control module. It will be appreciated that although the angle of the valve lift actuator 48 is depicted horizontally, it is within the scope of the disclosure that the angle may be of varying degrees to facilitate the operation of the valve lift actuator 48.

The engine valve 22 includes a retainer 24, a valve stem 26, and a valve spring 28. The retainer 24 is connected to the valve stem 26 and provides a contact area for the valve spring 28 to engage the engine valve 22. The retainer 24 therefore permits the valve spring 28 to bias the engine valve 22 toward the finger follower 11 to a valve closed position. The biasing force causes the finger follower 11 to pivot about the first end 16 about the valve lash adjuster 42. The contact surface 20 can be either a solid curved surface to allow unrestricted movement or a roller if reduced friction is desired.

The base 12 is slidably interconnected with the control guide 14 to allow the control guide 14 to move along the base 12. The movement of the control guide 14 may be translational or arcuate along the base 12, depending upon control surface therebetween. The control guide 14 is moveable to achieve a first position relative to the base 12 for operation in a high-lift valve mode, a second position relative to the base 12 for operation in a no-lift valve mode, and an intermediate position relative to the base 12 for operation in a low-lift valve mode in response to rotation of the cam lobe 38. The high-lift valve mode provides the largest achievable amount of valve lift with the combination of parts assembled when the engine valve 22 is in an open state. For example, the engine may be operative in one of a high-lift valve mode wherein the achievable lift is 8-13mm in one embodiment, a low-lift valve mode wherein the achievable lift is 4-6mm in one embodiment, and a no-lift valve mode wherein no valve lift is achieved preferably for use with a cylinder deactivation strategy.

The control guide 14 is towards the first position (i.e. biased rightward in the figure such that roller 36 is urged into engagement with cam lobe 38) by a biasing element 15, e.g., a coil spring, for interconnecting the control guide 14 at spring retention wall 17 and the base 12 at spring retention wall 19. In one embodiment, the control guide 14 is selectably lockable by a locking device 46 to the base 12 in one of the first and second positions using, e.g., a hydraulically actuated pin 46, as depicted. Actuation of pin 46 occurs when oil pressure presented to the pin 46 through an oil passage 34 reaches a predetermined threshold, causing the pin 46 to engage a recess 35 of the control guide 14. The pin 46 retracts and disengages from the recess 35 when oil pressure in the oil passage 34 is less than the predetermined threshold. The exemplary hydraulically actuated pin 46 is but one example of a locking mechanism and others, such as magnetic actuation or electric switching, are contemplated.

The cam lobe 38 includes a cam lobe peak 39 and a cam lobe base 37 and is fixedly secured to the camshaft 35. The camshaft 35 is synchronized to rotate with engine crank rotation during engine operation. Therefore, the cam lobe 38 is continually rotating during engine operation thereby presenting both the cam lobe base 37 and the cam lobe peak 39 once per revolution. The cam lobe base 37 is a portion of the cam lobe 38 that allows the engine valve 22 to be in a closed position in each valve mode. The cam lobe peak 39 is a portion of the cam lobe 38 for providing pivotal motion of the finger follower 11 about the first end 16 to cause the engine valve 22 to open to the peak position of the particular profile enabled (e.g. high-lift or low-lift).

The valve opening profile, including opening and closing ramp rates and peak opening, is determined by the cam lobe 38, the control surface 32 profile of the control guide 14, and the cooperative relationship of the control surface 32 with the valve lift actuator 48. When the control guide 14 is not locked to the base 12, the guide roller 50 may be positioned to effectively engage the control surface 32 throughout at least a portion of the rotation of the cam lobe. Until the control surface 32 comes into effective engagement with the guide roller 50, rotation of the cam lobe 38 will freely slide the control guide 14 leftward in the figure along the base 12 without sufficient force generated to pivot the finger follower 11 to effect a valve opening (i.e. lost motion) Once the control surface 32 comes into effective engagement with the guide roller 50, the sliding of the control guide is limited and sufficient force generated to pivot the finger follower 11 to effect a valve opening The control surface portion 32 may be tunable for a specific engine and desired engine characteristics without having to adjust the profile of the cam lobe 38. For example, the control surface portion 32 is shown in a concave profile for less aggressive valve opening response; however, if the engine requires faster valve opening response, the surface instead can have a convex orientation. The magnitude of valve lift may also be varied by similar means, e.g., additional material or a different control surface portion 32 profile can be provided to move the top 44 closer to the valve lift actuator 48 in the valve open position thereby creating additional valve lift for any given valve lift actuator setting or position.

The valve lift actuator 48 selectively engages the control surface portion 32 to control the sliding motion to the control guide 14 relative to the base 12. The biasing arm 54 and guide roller 50 are extendable between a completely extended position and a completely retracted position via linear actuator 52.

When the linear actuator 52 extends the biasing arm 54 and guide roller 50 to the completely extended position, the control guide 14 is in a first position relative to the base 12 for operation of the valve in either the high-lift valve mode or the low-lift valve mode. If pin 46 is engaged, then control guide 14 is fixed to base 12 and is not free to slide. Thus when the cam lobe acts on the roller 36, full cam motion is imparted to the base 12 and maximum valve lift results.

When the linear actuator 52 extends the biasing arm 54 and guide roller 50 to the completely retracted position, the control guide 14 is in a second position relative to the base 12, indicating operation in a no-lift valve mode. In such arrangement, the control guide is free to slide leftward in the figure without the control surface ever cooperatively contacting the guide roller to limit the motion of the control guide during cam lobe rotation.

Figure 2:
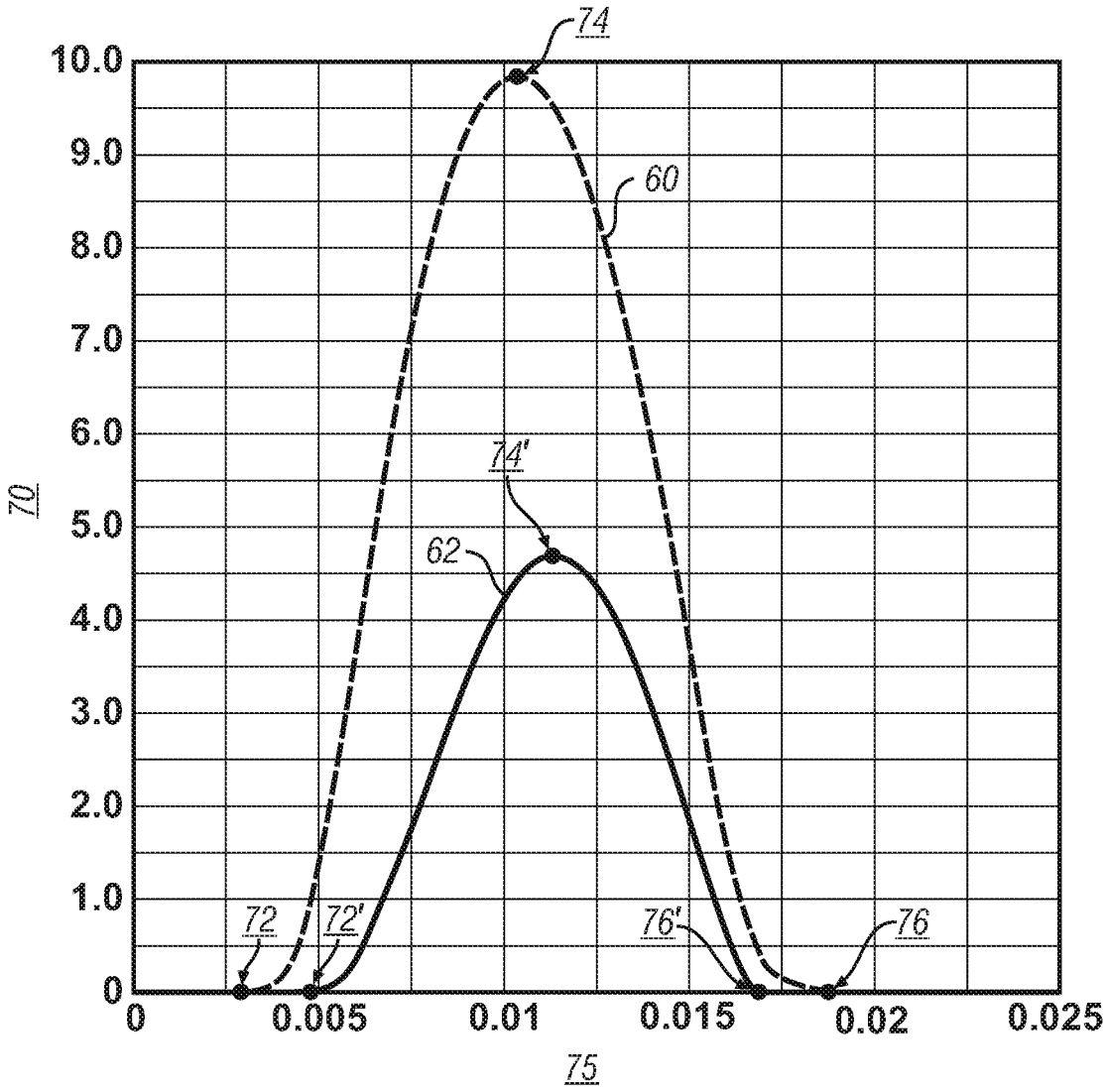
FIG. 2 is a graphical depiction of valve lift for an engine valve in response to rotation of a cam when controlled in a high-lift valve mode and when controlled in a low-lift valve mode showing valve lift in millimeters over time for an exemplary embodiment of the valve activation system shown in FIG. 1, in accordance with the present disclosure.

FIG. 2 is a graphical depiction of lift for an engine valve 22 in response to rotation of a cam 35 when controlled in a high-lift valve mode (60) and when controlled in a low-lift valve mode (62) showing valve lift in millimeters 70 over time in seconds 75 for an exemplary embodiment of the valve activation system described in FIG. 1. During operation in the high-lift valve mode (60), the engine valve 22 begins to open at point 72 and achieves its maximum lift at point 74 before closing at point 76. During operation in the low-lift valve mode (62), the valve begins to open at point 72' and achieves its maximum lift at point 74' before closing at point 76'. In the exemplary high-lift and low-lift valve modes, (60) and (62) respectively, it should be noted that with the particular design of the control surface portion 32 as modeled, the low-lift peak valve lift time 74' phase-shifts relative to the high-lift peak 74. Further, the valve open time for the low-lift valve mode (62) is less than the high lift valve mode (60), represented by the difference from 72 to 76 for the high-lift valve mode to 72' to 76' for the low-lift valve mode. As discussed above, the valve opening profile, including opening and closing ramp rates and peak opening, is determined by the cam lobe 38, the control surface 32 profile of the control guide 14, and the cooperative relationship of the control surface 32 with the valve lift actuator 48.

Figure 3A:
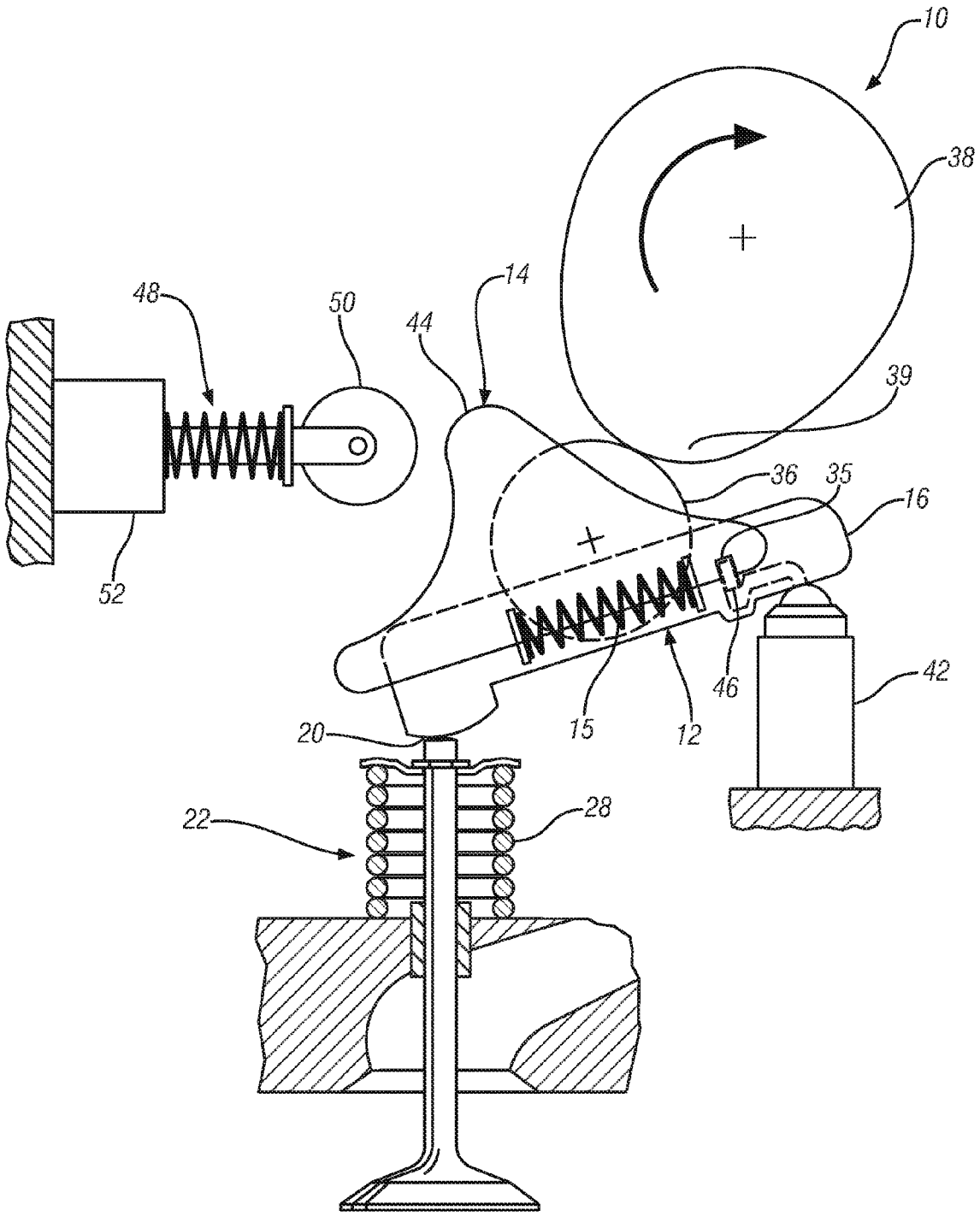
FIG. 3A is a schematic drawing of the finger follower of FIG. 1 controlled in the high-lift valve mode during operation with the engine valve controlled in a representative open position, in accordance with the present disclosure.

FIG. 3A is a schematic drawing of the finger follower 11 controlled in the high-lift valve mode during operation with the engine valve 22 controlled in a representative open position. As depicted, when the finger follower 11 is in the first position associated with the high lift valve mode, the base 12 and the control guide 14 are locked by activating the pin 46 to prevent sliding motion between the two. The pin 46 therefore allows only one degree of freedom for the finger follower 11, i.e., pivotal motion about the first end 16 upon the valve lash adjuster 42.

The rotating cam lobe 38 presents the cam lobe peak 39 to the roller 36 thereby turning rotational motion of the cam lobe 38 to pivotal motion of the finger follower 11 about the first end 16. The pivotal motion of the finger follower 11 overcomes the bias of the valve spring 28 and converts the pivotal motion into linear motion of the engine valve 22. Since the control guide 14 is locked in the first position by activation of the pin 46 at the recess 35, the complete cam lobe peak 39 displacement is transmitted through the control guide 14 to the base 12. The base 12 rotates about the first end 16 thereby overcoming the bias of the valve spring 28 and displacing the engine valve 22 in the high lift mode in response to rotation of the cam lobe 38. The finger follower 11, and more specifically, the control guide 14 becomes disengaged from the valve lift actuator 48 as the engine valve 22 becomes displaced. When the engine valve 22 returns to the closed position, the control guide 14 reengages the valve lift actuator 48.

Figure 3B:
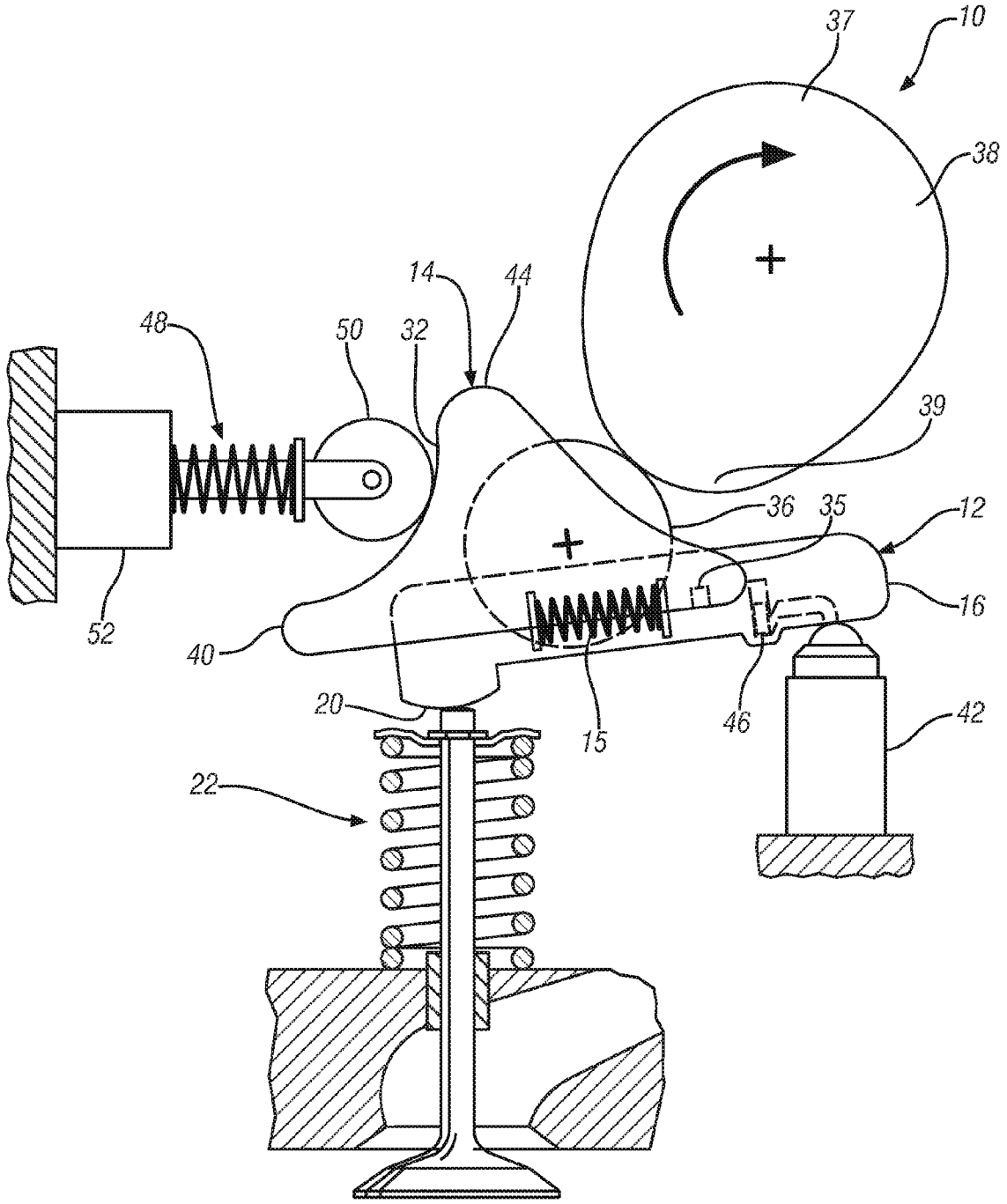
FIG. 3B is a schematic depiction of the finger follower of FIG. 1 controlled in an intermediate low-lift valve mode with the engine valve controlled in a representative open position, in accordance with the present disclosure.

FIG. 3B is a schematic depiction of the finger follower 11 controlled in an intermediate low-lift valve mode with the engine valve 22 controlled in a representative valve open position. A low-lift valve mode is preferably for a low speed, low load engine operation wherein the achievable lift is approximately 4-6 mm, in one embodiment. When the finger follower 11 is in the intermediate position, the base 12 and the control guide 14 are unlocked such that the control guide 14 is slidable along the base 12. The control guide 14 is engaged with the valve lift actuator 48. The biasing member 15 ensures the roller 36 maintains contact with the cam lobe 38 regardless if the position presented is the cam lobe base 37 or cam lobe peak 39. When the roller 36 is along the cam lobe base 37, the engine valve 22 is in a closed position, as depicted in FIG. 1.

The camshaft 38 rotates forcing the cam lobe peak 39 to engage the roller 36. The cam lobe peak 39 displaces the roller 36 overcoming the biasing member 15 thereby sliding the control guide 14 along the base 12 toward the valve lift actuator 48. The guide roller 50 is already engaged with the control surface portion 32 at the base 40. As the control guide 14 slides toward the valve lift actuator 48, the guide roller 50 engages the control surface portion 32. Since the valve lift actuator 48 is rigidly locked in position, the control surface portion 32, being arcuate in one embodiment, imbues a pivoting motion about the first end 16 to overcome the spring force of the engine valve 22. This action permits two degrees of freedom for the finger follower 11, i.e., pivotal motion about the first end 16 and sliding motion between the control guide 14 and the base 12. When the guide roller 50 is proximate the top 44, the engine valve 22 is in its most open position in the low lift mode. The sliding motion of the control guide 14 relative to the base 12 results in lost motion. The lost motion results in reducing an associated valve lift to create the intermediate low-lift position.

Figure 3C:
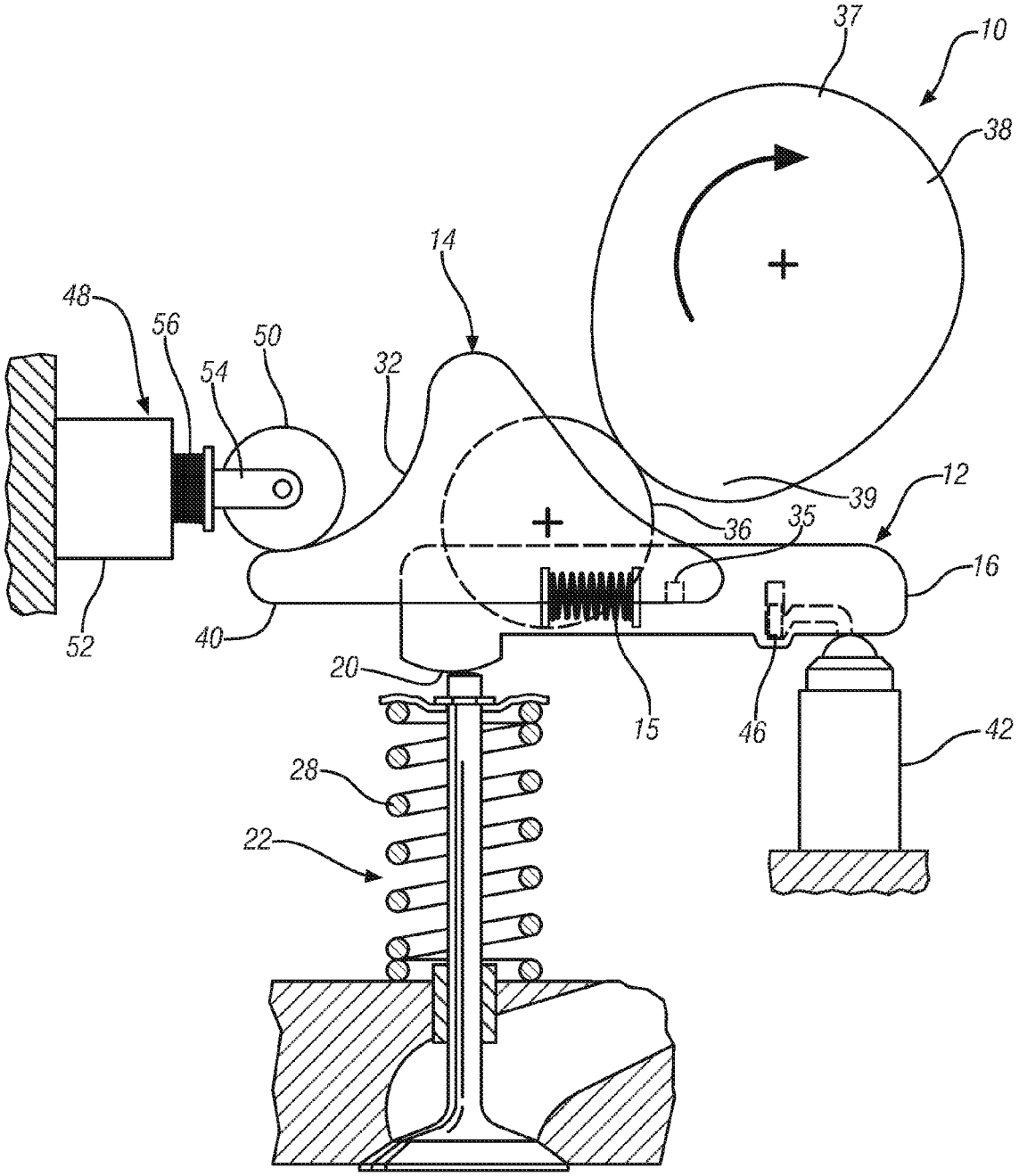
FIG. 3C is a schematic depiction of the finger follower of FIG. 1 in a no lift valve position with the engine valve in a representative closed position, in accordance with the present disclosure.

FIG. 3C is a schematic depiction of the finger follower 11 in a no lift valve position with the engine valve 22 in a representative closed position. When the finger follower 11 is in the no lift mode, neither the control guide 14 nor the valve lift actuator 48 are locked in position thus allowing three degrees of freedom, i.e., pivotal motion about the first end 16, sliding motion between the control guide 14 and the base 12, and compression of the valve lift actuator 48. The biasing member 15 ensures the roller 36 maintains contact with the cam lobe 38 as it rotates through the cam base 37 and the cam lobe peak 39. The roller 36 is along the cam lobe base 37 and the engine valve 22 is in a closed position, as depicted in FIG. 1.

The cam lobe 38 rotates forcing the cam lobe peak 39 to engage the roller 36. The cam lobe peak 39 displaces the roller 36 overcoming the biasing member 15 thereby sliding the control guide 14 along the base 12 toward the valve lift actuator 48. The guide roller 50 is initially engaged with the control surface portion 32 at the base 40. As the control guide 14 slides toward the valve lift actuator 48, the linear actuator 52 is no longer controlled in the extended position. The valve lift actuator 48 overcomes the biasing member 56 causing the biasing arm 54 to collapse within the linear actuator 52 to the retracted position. The combination of the sliding movement of the control guide 14 and the collapsing of the valve lift actuator 48 create enough lost motion to absorb the lift associated with the cam lobe peak 39 thereby avoiding any relative valve motion. This action permits three degrees of freedom for the finger follower 11, i.e., pivotal motion about the first end 16, sliding motion between the control guide 14 and the base 12, and retracting motion of the valve lift actuator 48.

In an additional embodiment, the finger follower 11 is as described with relation to FIG. 1. However, the valve lift actuator 48 is continuously variable between an extended position and a retracted position. The guide roller 50 engages the base 40 and provides constant contact with the control surface portion 32 in the extended position. The base 12 and the control guide 14 are no longer lockable in the high valve lift position. Instead, the linear actuator 52 of the valve lift actuator 48 is infinitely adjustable between the extended position and the retracted position.

To obtain the high lift valve position, the linear actuator 52 is in the extended position engaging the guide roller 50 with the control surface portion 32. In this embodiment, an engine controller controls the distance the linear actuator 52 extends the guide roller 50. Controlling the extension amount of the guide roller 50 has a direct relationship to the corresponding valve lift. For example, when the linear actuator 52 is in the fully extended position, the engine valve 22 is actuated in the high lift mode. To actuate the engine valve 22 in the low-lift mode, the linear actuator 52 is controlled to extend the guide roller 50 to a position that permits low-lift valve opening. The linear actuator 52 is controlled to allow a no-lift valve mode by permitting the guide roller 50 to retract towards the linear actuator 52.

The linear actuator 52 therefore has direct control over the magnitude of valve lift and extends and retracts to provide the appropriate valve lift for a specific set of operating conditions. As will be appreciated, this enables the valve lift to be continuously variable to maximize engine efficiencies across the entire operational range. It will also be apparent that cam phasing can be affected in a similar manner. That is, since the linear actuator 52 is able to affect the valve closing during the cam lobe peak 39, the finger follower 11 is able to effectuate closing the valve at any time by retracting the valve lift actuator 48. Likewise, the valve lift actuator 48 may be extended at any cam lobe position. This allows a controllable continuous valve phasing in addition to lift. It is appreciated that this permits a multitude of valve actuation strategies based on a single cam profile.

In an additional embodiment the finger follower 11 is as described with relation to FIG. 1 including the base 12 and the control guide 14. The base 12 is pivotally interconnected to the lash adjuster about the first end 16 and extends to a contact surface 20 at the second end 18. The base 12 slidably engages the control guide 14 to allow the control guide 14 to move between the first position, indicative of operation in a high-lift valve mode, the intermediate position, indicative of a low-lift valve mode, and the second position, indicative of a no-lift valve mode. The control guide 14 is also substantially the same as above, having a roller 36 to engage the cam lobe 38. However, neither the control surface portion 32 nor the valve lift actuator 48 is necessary as the locking device 46 is operable in discrete settings. Whereas only a single lock position is illustrated, one having ordinary skill in the art will appreciate that the control guide 14 may be locked at different, discrete locations along the base 12. The locking device 46 prevents movement between the base 12 and the control guide 14 to create the first position, the intermediate position, and the second position.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A finger follower apparatus to effect opening of an engine valve, comprising:

a first member including first and second opposite ends, the first member being pivotally fixed at the first end and operatively engaged with the engine valve at the second end;

a second member slidably engaged with the first member and carrying a first roller engaged with a cam, said second member having a control surface which when cooperatively engaged with a second roller of a valve actuator in response to said cam rotation establishes a valve lift profile for the engine valve, wherein the control surface comprises an arcuate surface;

the valve lift actuator comprising a linear actuator rigidly mounted to the engine and having an extendable biasing arm connected at a distal end to the second roller, the biasing arm including a biasing member between the linear actuator and a retention plate, wherein the biasing member is configured to bias the biasing arm in a first direction toward the first member;

the linear actuator selectively engaging the second roller with the control surface and selectable to linearly translate the biasing arm between a fully extended position in the first direction toward the first member and a fully retracted position in an opposite second direction away from the first member to enable continuously variable adjustment of a peak magnitude of lift during an opening profile for the engine valve, comprising the fully extended position actuating the engine valve in a high-lift mode, wherein the high-lift mode comprises the peak magnitude of lift of the engine valve at a high peak position when a cam lobe peak of the cam is engaged with the first roller and the closed position when a cam lobe base is engaged with the first roller, the fully retracted position actuating the engine valve in a no-lift mode comprising no lift of the engine valve, wherein the no-lift mode comprises the linear actuator controlled to overcome the biasing member such that the biasing arm linearly translates to the fully retracted position as engagement between the cam lobe and the first roller translationally slides the second member along the first member in the second direction while the control surface of the second member is engaged to the second roller, the linear translation of the biasing arm to the fully retracted position prevents any occurrence of lift of the engine valve regardless of the engagement between the first roller and each of the cam lobe peak and the cam lobe base, and an intermediate extended position actuating the engine valve in a low-lift mode, wherein the low-lift mode comprises the peak magnitude of lift of the engine valve at a low peak position when the cam lobe peak is engaged with the first roller and the closed position when the cam lobe base is engaged with the first roller, the peak magnitude of lift of the low peak position less than the peak magnitude of lift of the high peak position; and a locking device selectively activated to prevent slidable motion between the first member and the second member causing the first member and the second member to jointly pivot about the first end to actuate the engine valve in the high-lift mode, wherein the control surface becomes disengaged from the second roller of the valve lift actuator as the cam lobe peak directly engages the cam roller of the second member, the first and second members, including the cam roller, jointly pivot about the first end and the engine valve is displaced from the closed position.

2. A finger follower apparatus to effect opening of an engine valve, comprising:

an elongated base including a first end, a slidable surface, and a second end wherein the first end includes a pivot point about a valve lash adjuster and the second end includes a valve contact surface for contacting the engine valve;

a control guide slidably interconnected to the slidable surface of the elongated base, the control guide including a cam roller and a control surface;

a cam lobe synchronized for common rotation with engine crank rotation and configured to engage the cam roller of the control guide, the cam lobe including a cam lobe base which when engaged with the cam roller eliminates pivotal motion around the pivot point of the elongated based to operate the engine valve in a closed position comprising no lift of the engine valve, and a cam lobe peak which when engaged with the cam roller provides pivotal motion around the pivot point of the elongated base to allow the engine valve to open to a peak position;

a valve lift actuator comprising a linear actuator rigidly mounted to the engine and having an extendable biasing arm connected at a distal end to a guide roller, the biasing arm including a biasing member between the linear actuator and a retention plate, wherein the biasing member is configured to bias the biasing arm in a first direction toward the elongated base; and the linear actuator selectively engaging the guide roller with the control surface of the control guide, the linear actuator selectable to linearly translate the biasing arm between a fully extended position in the first direction toward the elongated base and a fully retracted position in an opposite second direction away from the elongated base to enable continuously variable adjustment of a peak magnitude of lift during an opening profile of the engine valve, comprising the fully extended position actuating the engine valve in a high-lift mode, wherein the high-lift mode comprises the peak magnitude of lift of the engine valve at a high peak position when the cam lobe peak is engaged with the cam roller and the closed position when the cam lobe base is engaged with the cam roller, the fully retracted position actuating the engine valve in a no-lift mode comprising no lift of the engine valve, wherein the no-lift mode comprises the linear actuator controlled to overcome the biasing member such that the biasing arm linearly translates to the fully retracted position as engagement between the cam lobe and the cam roller translationally slides the control guide along the elongated base in the second direction while the control surface of the control guide is engaged to the guide roller, the linear translation of the biasing arm to the fully retracted position prevents any occurrence of lift of the engine valve regardless of the engagement between the cam roller and each of the cam lobe peak and the cam lobe base, and an intermediate extended position actuating the engine valve in a low-lift mode, wherein the low-lift mode comprises the peak magnitude of lift of the engine valve at a low peak position when the cam lobe peak is engaged with the cam roller and the closed position when the cam lobe base is engaged with the cam roller, the peak magnitude of lift of the low peak position less than the peak magnitude of lift of the high peak position;

a locking device selectively activated to prevent motion between the control guide and the elongated base causing the elongated base and the control guide to jointly pivot about the first end to actuate the engine valve in the high-lift mode, wherein the control surface becomes disengaged from the guide roller of the valve lift actuator as the cam lobe peak directly engages the cam roller of the second member, the first and second members, including the cam roller, jointly pivot about the first end and the engine valve is displaced from the closed position.

3. The apparatus of claim 2, wherein the control surface of the control guide comprises an arcuate surface.

4. The apparatus of claim 2, wherein the control surface the control guide comprises a flat surface.

5. The apparatus of claim 2, wherein the locking device selectively prevents motion between the control guide and the elongated base at a plurality of relative positions of the control guide and the elongated base.

6. A finger follower apparatus to effect opening of an engine valve, comprising:

a first member including first and second opposite ends, the first member being pivotally fixed at the first end and operatively engaged with the engine valve at the second end;

a second member slidably engaged with the first member, the second member including a cam roller for engagement with a cam and a control surface, wherein the control surface comprises an arcuate surface;

a cam lobe synchronized for common rotation with engine crank rotation and configured to engage the cam roller, the cam lobe including a cam lobe base which when engaged with the cam roller eliminates pivotal motion around the first end of the first member to operate the engine valve in a closed position comprising no lift of the engine valve, and a cam lobe peak which when engaged with the cam roller provides pivotal motion around the first end of the first member to allow the engine valve to open to a peak position;

a valve lift actuator comprising a linear actuator rigidly mounted to the engine and having an extendable biasing arm connected at a distal end to a guide roller, the biasing arm including a biasing member between the linear actuator and a retention plate, wherein the biasing member is configured to bias the biasing arm in a first direction toward the first member;

the linear actuator selectively engaging the guide roller with the control surface of the second member, the linear actuator selectable to linearly translate the biasing arm between a fully extended position in the first direction toward the first member and a fully retracted position in an opposite second direction away from the first member to enable continuously variable adjustment of a peak magnitude of lift during an opening profile of the engine valve, comprising the fully extended position actuating the engine valve in a high-lift mode, wherein the high-lift mode comprises the peak magnitude of lift of the engine valve at a high peak position when the cam lobe peak is engaged with the cam roller and the closed position when the cam lobe base is engaged with the cam roller, the fully retracted position actuating the engine valve in a no-lift mode comprising no lift of the engine valve, wherein the no-lift mode comprises the linear actuator controlled to overcome the biasing member such that the biasing arm linearly translates to the fully retracted position as engagement between the cam lobe and the cam roller translationally slides the second member along the first member in the second direction while the control surface of the second member is engaged to the guide roller, the linear translation of the biasing arm to the fully retracted position prevents any occurrence of lift of the engine valve regardless of the engagement between the cam roller and each of the cam lobe peak and the cam lobe base, and an intermediate extended position actuating the engine valve in a low-lift mode, wherein the low-lift mode comprises the peak magnitude of lift of the engine valve at a low peak position when the cam lobe peak is engaged with the cam roller and the closed position when the cam lobe base is engaged with the cam roller, the peak magnitude of lift of the low peak position less than the peak magnitude of lift of the high peak position; and a locking device selectively activated to prevent slidable motion between the first member and the second member causing the first member and the second member to jointly pivot about the first end to actuate the engine valve in the high-lift mode, wherein the control surface becomes disengaged from the guide roller of the valve lift actuator as the cam lobe peak directly engages the cam roller of the second member, the first and second members, including the cam roller, jointly pivot about the first end and the engine valve is displaced from the closed position.

* * * * *